US007591092B2

(12) United States Patent
Wolf

(10) Patent No.: US 7,591,092 B2
(45) Date of Patent: Sep. 22, 2009

(54) APPARATUS, A SYSTEM AND A METHOD FOR LABELING A BEVERAGE CONTAINER

(76) Inventor: Timothy Wolf, 2183 Cottonwood Dr., Glenview, IL (US) 60025

( * ) Notice: Subject to any disclaimer, the term of this patent is extended or adjusted under 35 U.S.C. 154(b) by 735 days.

(21) Appl. No.: 10/868,514

(22) Filed: Jun. 15, 2004

(65) Prior Publication Data

US 2005/0274053 A1 Dec. 15, 2005

(51) Int. Cl.
*G09F 3/00* (2006.01)

(52) U.S. Cl. ..... 40/310; 215/230

(58) Field of Classification Search ..... 40/310, 40/306, 637; 24/30.5 R, 30.5 P, 501, 511; D19/65, 90; D8/395; 132/276, 277; 215/230
See application file for complete search history.

(56) References Cited

U.S. PATENT DOCUMENTS

| | | | | | |
|---|---|---|---|---|---|
| 1,133,388 | A | | 3/1915 | Merrill | |
| 1,237,700 | A | | 8/1917 | Roberts | |
| 1,965,554 | A | * | 7/1934 | Mainwaring | 24/558 |
| 2,457,898 | A | * | 1/1949 | Hummel | 220/759 |
| 2,553,070 | A | * | 5/1951 | Van Megroot | 602/22 |
| 2,976,629 | A | | 3/1961 | Brixius et al. | |
| 4,277,864 | A | * | 7/1981 | Orson, Sr. | 24/327 |
| 4,483,622 | A | | 11/1984 | Muhi et al. | |
| 4,759,139 | A | | 7/1988 | Ricks | |
| 4,807,782 | A | | 2/1989 | Meinerding et al. | |
| D342,890 | S | * | 1/1994 | Ramierz | D8/395 |
| 5,339,549 | A | | 8/1994 | David et al. | |
| 5,358,770 | A | | 10/1994 | Evans | |
| D352,314 | S | * | 11/1994 | Wolff | D19/65 |
| 5,640,742 | A | * | 6/1997 | White et al. | 24/3.12 |
| D385,188 | S | * | 10/1997 | Williams | D9/434 |
| D386,215 | S | * | 11/1997 | White et al. | D20/43 |
| 5,704,144 | A | | 1/1998 | Groth | |
| 5,799,815 | A | | 9/1998 | Lang | |
| 5,884,371 | A | * | 3/1999 | Huggins | 24/300 |
| D420,912 | S | * | 2/2000 | Vaught | D9/435 |
| D423,305 | S | * | 4/2000 | Foster et al. | D7/686 |
| 6,082,030 | A | | 7/2000 | Kesseling et al. | |
| 6,086,702 | A | * | 7/2000 | Rea | 156/247 |
| 6,257,872 | B1 | | 7/2001 | Williams | |
| 6,332,712 | B1 | * | 12/2001 | Headley | 383/64 |
| D468,356 | S | * | 1/2003 | Snell | D19/65 |
| 6,530,163 | B2 | | 3/2003 | Skapyak et al. | |
| 6,615,517 | B2 | | 9/2003 | King | |
| 6,925,687 | B1 | * | 8/2005 | Overton | 24/7 |
| D512,906 | S | * | 12/2005 | Wood | D8/395 |
| 7,066,185 | B2 | * | 6/2006 | Hildebrandt | 132/210 |

(Continued)

FOREIGN PATENT DOCUMENTS

GB 2228038 A * 8/1990

*Primary Examiner*—Gary C Hoge
(74) *Attorney, Agent, or Firm*—Patents+TMS, P.C.

(57) ABSTRACT

An apparatus, a system and a method for labeling a beverage container have a first arm and/or a second arm. The first arm is connected to the second arm by a connector. A top end of a beverage container is inserted between the first arm and the second arm. The first arm and the second arm attach to and/or hold the top end of the beverage container. Moreover, the first arm and/or the second arm display indicia thereon for labeling the beverage container. The beverage container is identifiable with the indicia, the first arm and/or the second arm.

12 Claims, 2 Drawing Sheets

U.S. PATENT DOCUMENTS

2002/0162863 A1* 11/2002 Brincat ..... 222/568
2003/0046846 A1 3/2003 Goodman
2003/0098035 A1* 5/2003 Hildebrandt ..... 132/277
2003/0226298 A1 12/2003 Bjork
2004/0148827 A1* 8/2004 Arroyo ..... 40/306

* cited by examiner

INDICIA

APPARATUS, A SYSTEM AND A METHOD FOR LABELING A BEVERAGE CONTAINER

BACKGROUND OF THE INVENTION

The present invention generally relates to an apparatus, a system and a method used with a beverage container. More specifically, the present invention relates to an apparatus, a system and a method for labeling a beverage container. The apparatus, the system and the method may have a first arm and/or a second arm. The first arm and the second arm may have bottom edges and/or top edges. The top edges of the first arm and the second arm may be opposite to the bottom edges of the first arm and the second arm, respectively. The first arm may be attached to the second arm with a connector. The connector may have a spring which may force the top edge of the first arm outward with respect to the top edge of the second arm. As a result, the bottom edge of the first arm may be pushed inward with respect to the bottom edge of the second arm. A top end of a beverage container may be inserted between the bottom edges of the first arm and the second arm, respectively. As a result, the first arm and the second arm may hold and/or may be attached to the top end of the beverage container. Moreover, the first arm and/or the second arm may have indicia thereon to provide a label for the beverage-container.

It is generally known that vendors and/or retailers sell beverages to consumers in single serving containers, such as, for example, juice boxes, juice pouches and/or the like. A consumer opens the container to consume the beverages therein by inserting a plastic straw into an opening in the container. The consumer drinks and/or consumes the beverage from the container via the straw. Further, the consumer may fail to consume the entirety of the beverage contained within the container and/or may save portions of the beverages for consumption at a later time. The consumer stores the container in a location for later consumption. However, the straw in the container is contaminated with bacteria and/or germs from the consumer. The container which belongs to the consumer is not labeled and/or cannot be identified from a similar container being drank by another consumer. A first consumer may mistakenly consume the beverage from a container used by a second consumer. The bacteria and/or the germs of the second consumer are passed to the first consumer via the straw in the container. As a result, the first consumer may contract a sickness, an illness and/or a disease from the second consumer.

It is known to provide a label for a beverage container to identify the container and/or an owner of the container. One known identifier is a label in the form of a medallion attached to an elastic band. The elastic band is placed around an exterior of the beverage container. The elastic band contracts inward with respect to an exterior of the beverage container. As a result, the medallion is held against the exterior of the beverage container by the elastic band. However, the elastic band exerts a force inward with respect to the exterior of the beverage container. The exterior of the beverage container must be made from, for example, glass to withstand the inward force exerted by the elastic band. A beverage container, such as, for example, a juice box and/or a juice pouch collapses inward from the force of the elastic band. As a result, the beverage within the beverage container is pushed out the opening of and/or the straw inserted in the opening of the beverage container. Therefore, elastic bands with medallions can not be used to label beverage containers, such as, for example, juice boxes and/or juice pouches.

A need, therefore, exists for an apparatus, a system and a method for labeling a beverage container. Additionally, a need exists for an apparatus, a system and a method for labeling a beverage container which may identify the beverage container. Further, a need exists for an apparatus, a system and a method for labeling a beverage container which may attach to a top edge of the beverage container without damaging the exterior of the beverage container. Still further, a need exists for an apparatus, a system and a method for labeling a beverage container which may be removed from the beverage container. Moreover, a need exists for an apparatus, a system and a method for labeling a beverage container which may be disposable and/or reusable.

SUMMARY OF THE INVENTION

The present invention generally relates to an apparatus, a system and a method used with a beverage container. More specifically, the present invention relates to an apparatus, a system and a method for labeling a beverage container. The apparatus, the system and the method may have a first arm and/or a second arm. The first arm may be connected to the second arm. The first arm and/or the second arm may have bottom edges and/or top edges. The top edges of the first arm and the second arm may be opposite to the bottom edges of the first arm and the second arm, respectively. The first arm may be attached to the second arm with a connector. A top end of a beverage container may be inserted between the bottom edges of the first arm and the second arm. As a result, the first arm and the second arm may hold and/or may be attached to the top end of the beverage container. Moreover, the first arm and/or the second arm may have indicia thereon for labeling and/or identifying the beverage container.

The apparatus, the system and the method for labeling a beverage container may be, for example, a clip. The connector between the first arm and the second arm may be, for example, a spring. The spring may be, for example, a straight torsion spring, a flat spring and/or the like. The connector and/or the spring may force the top edge of the first arm outward with respect to the top edge of the second arm. As a result, the bottom edges of the first arm and the second arm may be forced inward with respect to each other. The top end of the beverage container may be held between the bottom edges of the first side and the second side, respectively. The indicia, the first side and/or the second side of the apparatus may provide a label for the beverage container. A user may identify the beverage container via the indicia, the first side and/or the second side of the apparatus.

To this end, in an embodiment of the present invention, an apparatus for identifying a container is provided. The apparatus has a first arm having a length defined between a first end and a second end opposite to the first end wherein the first arm has a top edge and a bottom edge opposite to the top edge. Further, the apparatus has a first handle attached to the first arm wherein the first handle extends outward with respect to the top edge of the first arm and further wherein the first handle is adjacent to the first end of the first arm. Still further, the apparatus has a second arm having a length defined between a first end and a second end opposite to the first end wherein the second arm has a top edge and a bottom edge opposite to the top edge wherein the second arm is connected to the first arm and further wherein the container is interposed between the bottom edge of the first arm and the bottom edge of the second arm. Moreover, the apparatus has an identifier on the first arm.

In an embodiment, the apparatus has a pin attaching the second arm to the first arm.

In an embodiment, the apparatus has a spring between the first arm and the second arm.

In an embodiment, the first arm is a color.

In an embodiment, the apparatus has indicia on the first arm.

In an embodiment, the apparatus has ribs on the first handle.

In an embodiment, the apparatus has a second handle attached to the second arm.

In another embodiment of the present invention, a system for identifying a container from a plurality of containers is provided. The system has a first arm having a length defined between a first end and a second end opposite to the first end wherein the first arm has a top edge and a bottom edge opposite to the top edge. Further, the system has a second arm having a length defined between a first end and a second end opposite to the first end wherein the second arm has a top edge and a bottom edge opposite to the top edge wherein the second arm is connected to the first arm and further wherein the bottom edge of the first arm is adjacent to the bottom edge of the second arm. Moreover, the system has an attaching means between the first arm and the second arm wherein the attaching means is adjacent to the first end of the first arm wherein the attaching means moves the bottom edge of the first arm outward with respect to the bottom edge of the second arm wherein the first arm and the second arm attach to the container and further wherein the container is distinguishable from the plurality of containers.

In an embodiment, the attaching means is a spring.

In an embodiment, the system has a pin attaching the first arm to the second arm.

In an embodiment, the system has a handle connected to the attaching means.

In an embodiment, the system has indicia on the first arm.

In another embodiment of the present invention, a method for identifying a container is provided. The method has the step of providing a clip having a length defined between a first end and a second end wherein the clip has an interior and an exterior. Further, the method has the step of providing a handle on the exterior of the first end of the clip to attach the clip to the container wherein the container is adjacent to the interior of the clip. Moreover, the method has the step of attaching an identifier to the exterior of the clip wherein the container is distinguished by the identifier.

In an embodiment, the method has the step of providing ribs on the handle.

In an embodiment, the method has the step of providing a spring in the clip.

In an embodiment, the method has the step of providing indicia on the exterior of the clip.

In an embodiment, the method has the step of attaching the clip to the container.

In an embodiment, the method has the step of providing an erasable surface on the exterior of the clip.

In an embodiment, the method has the step of attaching a sticker to the exterior of the clip.

In an embodiment, the method has the step of labeling the container with the clip.

It is, therefore, an advantage of the present invention to provide an apparatus, a system and a method for labeling a beverage container.

Another advantage of the present invention is to provide an apparatus, a system and a method for labeling a beverage container which provides identification of the beverage container.

And, another advantage of the present invention is to provide an apparatus, a system and a method for labeling a beverage container which provides a clip for attaching to a top of the beverage container.

Yet another advantage of the present invention is to provide an apparatus, a system and a method for labeling a beverage container which may be connected to the top of the beverage container.

A further advantage of the present invention is to provide an apparatus, a system and a method for labeling a beverage container which may be disposable.

Moreover, an advantage of the present invention is to provide an apparatus, a system and a method for labeling a beverage container which may be reusable.

And, another advantage of the present invention is to provide an apparatus, a system and a method for labeling a beverage container which provides printed indicia thereon to label and/or to identify the beverage container.

Yet another advantage of the present invention is to provide an apparatus, a system and a method for labeling a beverage container which may provide labeling for a juice container, a juice box, a juice pouch and/or the like.

Another advantage of the present invention is to provide an apparatus, a system and a method for labeling a beverage container which may provide handles for attachment to and/or removal from the beverage container.

Yet another advantage of the present invention is to provide an apparatus, a system and a method for labeling a beverage container which may provide a color to label and/or to identify the beverage container.

A still further advantage of the present invention is to provide an apparatus, a system and a method for labeling a beverage container which may prevent damage to the beverage container during attachment to and/or removal from the beverage container.

Moreover, an advantage of the present invention is to provide an apparatus, a system and a method for labeling a beverage container which may be packaged with the beverage container for sale.

And, another advantage of the present invention is to provide an apparatus, a system and a method for labeling a beverage container which may be inexpensive.

Yet another advantage of the present invention is to provide an apparatus, a system and a method for labeling a beverage container may provide a clip having a length to prevent swallowing of and/or choking on the clip by a consumer.

A further advantage of the present invention is to provide an apparatus, a system and a method for labeling a beverage container which may allow a consumer to drink from a straw inserted into the beverage container.

Moreover, an advantage of the present invention is to provide an apparatus, a system and a method for labeling a beverage container which may allow a consumer to identify the beverage container from a plurality of beverage containers.

And, another advantage of the present invention is to provide an apparatus, a system and a method for labeling a beverage container which prevents a consumer from mistakenly consuming from a beverage container not belonging to the consumer.

Yet another advantage of the present invention is to provide an apparatus, a system and a method for labeling a beverage container which prevents the passage of bacteria and/or germs of a first consumer to a second consumer via a straw in the beverage container.

A still further advantage of the present invention is to provide an apparatus, a system and a method for labeling a beverage container which may allow a consumer to identify the beverage container from which the consumer has been drinking.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figures 1, 2, 3:
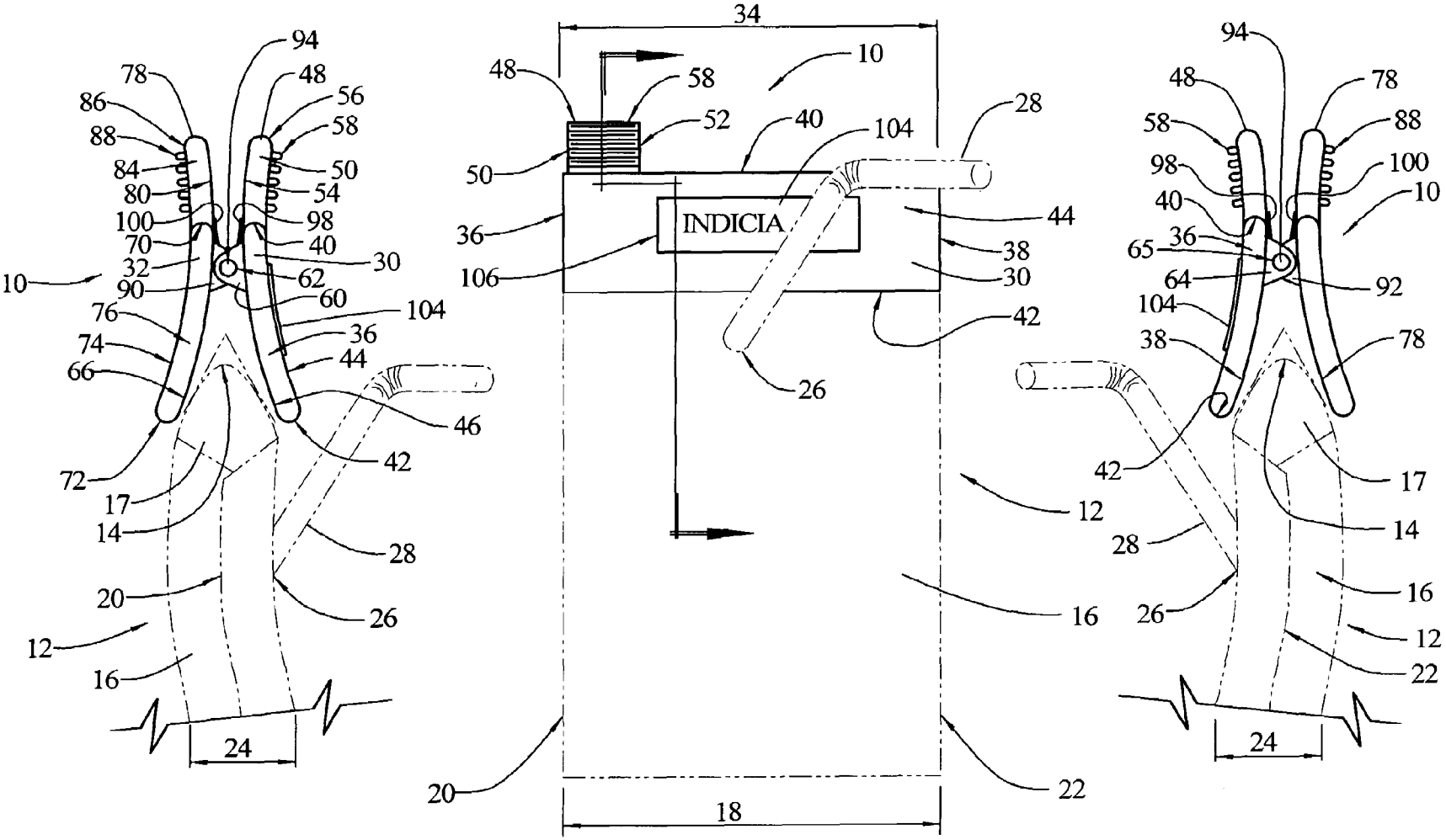
FIG. 1 illustrates a front plan view of an apparatus and a beverage container in an embodiment of the present invention.
FIG. 2 illustrates a left side view of the apparatus and the beverage container of FIG. 1 in an embodiment of the present invention.
FIG. 3 illustrates a right side view of the apparatus and the beverage container of FIG. 1 in an embodiment of the present invention.

The present invention generally relates to an apparatus, a system and a method used with a beverage container. More specifically, the present invention relates to an apparatus, a system and a method for labeling a beverage container. The apparatus, the system and the method may have a first arm and/or a second arm. The first arm may be attached to the second arm by a connector. The connector may be, for example, a straight torsion spring, a flat spring and/or the like. A top end of a beverage container may be inserted between the first arm and the second arm. As a result, the first arm and second arm may be attached to and/or may hold the top end of the beverage container. Moreover, the first arm and/or the second arm may have indicia thereon for labeling the beverage container. The indicia, the first arm and/or the second arm may label the beverage container. The indicia, the first arm and/or the second arm may allow a consumer to identify the beverage container.

Referring now to the drawings wherein like numerals refer to like parts, FIGS. 1-3 and 5 illustrate an apparatus 10 for labeling a beverage container 12 in an embodiment of the present invention. The beverage container 12 may have a top end 14 and/or an exterior 16. The beverage container 12 may have a length 18, a first end 20, a second end 22 and/or a width 24. The second end 22 may be opposite to the first end 20. The beverage container 12 may be made from a material, such as, for example, polyurethane, polyethylene, tin, aluminum, cardboard and/or the like. The beverage container 12 may contain a beverage, such as, for example, juice, milk, sports drink, fruit drink, and/or the like. The beverage container 12 may be, for example, a beverage box, a beverage pouch, a beverage container and/or the like. The present invention should not be deemed as limited to the embodiments of the material of the beverage container 12 and/or the beverage contained within the beverage container 12.

The beverage container 12 may have an opening 26 in the exterior 16. The opening 26 may extend through the beverage container 12 from the exterior 16 to an interior 17 of the beverage container. A straw 28 may be inserted into the opening 26 and/or the interior 17 of the beverage container 12. A first consumer (not shown in the drawings) may drink and/or may consume the beverage within the beverage container 12 via the straw 28. Moreover, the first consumer may discard the beverage container 12 after consuming the beverage within the beverage container 12.

However, the first consumer may not drink the entire beverage contained within the beverage container 12. The first consumer may choose to save a portion of the beverage or the entire beverage. The beverage container 12 may be stored, for example, on a shelf, on a table, in a picnic basket, in a box and/or the like. Further, the beverage in the beverage container 12 may require refrigeration after opening the same. As a result, the first consumer may store the beverage container 12 in, for example, a cooler, a refrigerator, an icebox and/or the like.

The first consumer may drink the beverage from the beverage container 12 via the straw 28. Germs and/or bacteria from the mouth, lips, saliva and/or tongue of the first consumer may pass to the straw 28 while drinking and/or consuming the beverage within the beverage container 12. As a result, the straw 28 and/or the beverage within the beverage container 12 may be contaminated with the germs and/or the bacteria of the first consumer. The germs and/or the bacteria on the straw 28 may pass to another consumer drinking from the beverage container 12.

The apparatus 10 may be attached to the top end 14 of the beverage container 12 to label and/or to identify the beverage container 12. A second consumer (not shown in the drawings) may be associated with the first consumer. The second consumer may be drinking from and/or consuming a beverage from a container (not shown in the drawing). The container belonging to the second consumer may be similar to or identical to the beverage container 12 belonging to the first consumer. Further, the apparatus 10 may identify the first consumer and/or may indicate to the second consumer that the beverage container 12 belongs to the first consumer. The second consumer may identify that the beverage container 12 belongs to the first consumer and/or may refrain from drinking and/or consuming the beverage therein. The second consumer may refrain from drinking for the beverage container 12 to prevent contraction of the germs and/or the bacteria of the first consumer from the straw 28. As a result, the apparatus 10 may prevent the germs and/or the bacteria of the first consumer on straw 28 from passing to the second consumer. Still further, the beverage container 12 may not be wrongfully discarded because the apparatus 10 identifies that the beverage container 12 belongs to the first consumer.

The apparatus 10 may have a first arm 30 and/or a second arm 32. The first arm 30 may have a length 34, a first end 36 and/or a second end 38. The length 34 of the first arm 30 may be equal to the length 18 of the beverage container 12. The second end 38 may be opposite to the first end 36. The first arm 30 may have a top edge 40 and/or a bottom edge 42. The bottom edge 42 may be opposite to the top edge 40. The first arm 30 may have an exterior surface 44 and/or an interior surface 46.

A first handle 48 may be attached to the top edge 40 of the first end 36 of the first arm 30. The first handle 48 may extend outward with respect to the top edge 40 of the first end 36. The first handle 48 may have a first end 50 and/or a second end 52. The second end 52 may be opposite to the first end 50. The first handle 48 may be integrally formed with the first arm 30. The first handle 48 may have an interior surface 54 and/or an exterior surface 56. The exterior surface 56 may have ribs 58.

The ribs 58 may extend across the exterior surface 56 from the first end 50 to the second end 52 of the first handle 48. The first handle 48 may have, for example, five ribs 58. The ribs 58 may be integrally formed with the first handle 48 and/or the first arm 30.

The interior surface 46 of the first end 36 of the first arm 30 may have a first mount 60. The first mount 60 may extend outward with respect to the interior surface 46 of the first arm 30. The first mount 60 may be located on the interior surface 46 between the top edge 40 and the bottom edge 42 of the first arm 30. The first mount 60 may be integrally formed with the first arm 30. The first mount 60 of the first arm 30 may have a hole 62 therein extending through the first mount 60.

The interior surface 46 of the first arm 30 may have a second mount 64. The second mount 64 may extend outward with respect to the interior surface 46 of the first arm 30. The second mount 64 may be located on the interior surface 46 between the top edge 40 and the bottom edge 42 of the first arm 30. The second mount 64 on the interior surface 46 may be adjacent to the second end 52 of the first handle 48. The second mount 64 may be integrally formed with the first arm 30. The second mount 64 of the first arm 30 may have a hole 65 therein extending through the second mount 64.

The second arm 32 may have the length 34, a first end 66 and/or a second end 68. The second end 68 may be opposite to the first end 66. The second arm 32 may have a top edge 70 and a bottom edge 72. The bottom edge 72 may be opposite to the top edge 70. The second arm 32 may have an exterior surface 74 and/or an interior surface 76.

A second handle 78 may be attached to the top edge 70 of the first end 66 of the second arm 32. The second handle 78 may extend outward with respect to the top edge 70 of the first end 66. The second handle 78 may have a first end 80 and/or a second end 82. The second end 82 may be opposite to the first end 80. The second handle 78 may be integrally formed with the second arm 32. The second handle 78 may have an interior surface 84 and/or an exterior surface 86. The exterior surface 86 may have ribs 88. The ribs 88 may extend across the exterior surface 86 from the first end 80 to the second end 82 of the second handle 78. The second handle 78 may have, for example, five ribs 88. The ribs 88 may be integrally formed with second handle 78 and/or the second arm 32. The ribs 58 and/or the ribs 78 may be used to grip and/or to hold the apparatus 10.

The interior surface 76 of the first end 66 of the second arm 32 may have a first mount 90. The first mount 90 may extend outward with respect to the interior surface 76 of the second arm 32. The first mount 90 may be located on the interior surface 76 between the top edge 70 and the bottom edge 72 of the second arm 32. The first mount 90 may be integrally formed with the second arm 32. The first mount 90 of the second arm 32 may be attached to the first mount 60 of the first arm 30.

The interior surface 76 of the second arm 32 may have a second mount 92. The second mount 92 may extend outward with respect to the interior surface 76 of the second arm 32. The second mount 92 may be located on the interior surface 76 between the top edge 70 and the bottom edge 72 of the second arm 32. The second mount 92 on the interior surface 76 may be adjacent to the second end 82 of the second handle 78. The second mount 92 may be integrally formed with the second arm 32. The second mount 92 of the second arm 32 may be attached to the second mount 64 of the first arm 30.

The first arm 30, the second arm 32, the first handle 48, the second handle 78, the first mounts 60, 90, the second mounts 64, 92, and/or the ribs 58, 88 may be made from a material, such as, for example, plastic, polyethylene, polyurethane and/or the like. The material may be a color, such as, for example, red, blue, green, white, black, purple, orange and/or the like. Further, the material may be a combination of more than one color. The first arm 30 and/or the second arm 32 may be molded by a molding procedure, such as, for example, injection molding, compression molding and/or the like. It should be understood that the first arm 30 and/or the second arm 32 may be made from any material, of any color or colors and/or by any method that may be implemented by one having ordinary skill in the art.

The first arm 30 may be connected to the second arm 32. The first mount 90 and second mount 92 of the second arm 32 may be inserted into first mount 60 and the second mount 64 of the first arm 30. As a result, the interior surfaces 46, 54 of the first arm 30 and the first handle 48, respectively, may be adjacent to the interior surfaces 84, 76 of the second arm 32 and the second handle 78, respectively. Further, the first end 36 of the first arm 30 may be adjacent to the first end 66 of the second arm 32. The hole 62 in the first mount 60 of the first arm 30 may align with the hole in the first mount 90 of the second arm 32. Still further, the hole 65 in the second mount 64 may align with the hole in the second mount 92 of the second arm 32.

Figure 4:
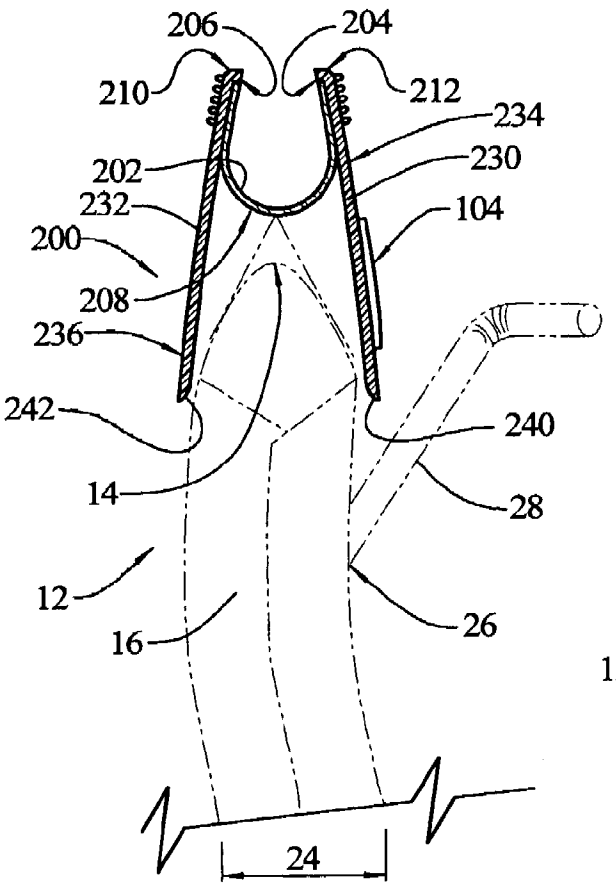
FIG. 4 illustrates a cross-sectional view of an apparatus and a beverage container as taken along line III-III of FIG. 1 in another embodiment of the present invention.

As illustrated in FIGS. 2, 3 and 4, a pin 94 may be inserted into the hole 62 of the first mount 60 of the first arm 30. Further, the pin 94 may extend through the first mount 60 into the hole of the first mount 90 of the second arm 32. A spring 96 may be located between the first mount 90 and the second mount 92 of the second arm 32. The spring 96 may be, for example, a torsion spring. Still further, the pin 94 may extend through the spring 96 into the hole of the second mount 92 of the second arm 32. Moreover, the pin 94 may extend through the hole of second mount 92 of the second arm 32 into the hole 65 of the second mount 64 of the first arm 30. As a result, the spring 96 may be connected between the first arm 30 and the second arm 32.

The spring 96 may have a first prong 98 and/or a second prong 100. The first prong 98 may be adjacent to the interior 46 of the first arm 30. The second prong 100 may be adjacent to the interior 76 of the second arm 32. The first prong 98 and/or the second prong 100 may extend outward with respect to the top edges 40, 70 of the first arm 30 and the second arm 32, respectively.

The first prong 98 and/or the second prong 100 of the spring 96 may exert forces outward with respect to each other. Further, the first prong 98 and the second prong 100 may push the first handle 48 of the first arm 30 outward with respect to the second handle 78 of the second arm 32. The pin 94 may be a pivot for the first arm 30 and/or the second arm 32. The bottom edge 42 of the first arm 30 may pivot inward with respect to the bottom edge 72 of the second arm 32 via the pin 94. As a result, the bottom edge 42 of the first arm 30 may be pushed inward with respect to the bottom edge 72 of the second arm 32. Still further, the bottom edge 42 of the first arm 30 may abut the bottom edge 72 of the second arm 32. Moreover, the first prong 98 and the second prong 100 may hold the bottom edge 42 of the first arm 30 against the bottom edge 72 of the second arm 32.

The first consumer may attach the apparatus 10 to the beverage container 12 by applying a force to the exterior surface 56 and/or the ribs 58 of the first handle 48. The force from the first consumer may move the first handle 48 inward with respect to the second handle 78. The force from the first consumer may overcome the outward force of the spring 98, the first prong 98 and/or the second prong 100. As a result, the first handle 48 and/or the top edge 40 of the first arm 30 may move inward with respect to the second handle 78 and the top edge 70 of the second arm 30, respectively. The bottom edge 42 of the first arm 30 may pivot outward with respect to the bottom edge 72 of the second arm 32 via the pin 94. As a result, the bottom edge 42 of the first arm 30 may be separated from the bottom edge 72 of the second arm 32. The first consumer may insert the top end 14 of the beverage container 12 between the bottom edges 42, 72 of the first arm 30 and the second arm 32. The first consumer may stop applying force to the first handle 48. The spring 96 may push the bottom edges 42, 72 of the first arm 30 and the second arm 32, respectively, inward with respect to each other. As a result, the top end 14 of the beverage container 12 may be held between the bottom edges 42, 72 of the first arm 30 and the second arm 32, respectively.

As illustrated in FIGS. 1-3 and 5, the first arm 30 and/or the second arm 32 may display an indicator, such as, for example, indicia 104. The indicia 104 may have a perimeter 106. The indicia 104 may be attached to the exterior surface 44 of the first arm 30 and/or the exterior surface 74 of the second arm 32. The perimeter 106 of the indicia 104 may be a shape, such as, for example, a square, a rectangle, a circle, an oval, a triangle, a star and/or the like. The present invention should not be deemed as limited to the embodiments of a shape of the perimeter 106 of indicia 104.

The indicia 104 may be marks, such as, for example, words, names, phrases, numerals, numerical sequences, designs, insignias, language characters, objects, images, cartoons and/or the like. Further, the indicia 104 may be a color, such as, for example, red, green, yellow, purple, blue, black, orange, white and/or the like. Still further, the marks may relate to a topic, such as, for example, a cartoon character, an athlete, a musical performer, a political figure, a visual scene, a competition, a written message, a theme and/or the like. Moreover, the indicia 104 may relate to an entity, such as, for example, an entertainment company, a food manufacturing company, a bottling company, a food processing company and/or the like. Further, the present invention should not be deemed as limited to the embodiments of specific marks, specific topics and/or specific entities of the indicia 104.

The indicia 104 may be on, for example, a sticker with an adhesive backside which may attach to the exterior surface 44 of the first arm 30 and/or the exterior surface 74 of the second arm 32. Further, the indicia 104 may be, for example, screened and/or stamped onto the exterior surface 44 of the first arm 30 and/or the exterior surface 74 of the second arm 32. Still further, the first arm 30 and/or the second arm 32 may be molded to contain and/or to display the indicia 104 by a molding procedure, such as, for example, injection molding, compression molding and/or the like. The exterior surfaces 44, 74 of the first arm 30 and the second arm 32, respectively, may be erasable surfaces, such as, for example, a message board. The indicia 104 may be written onto the exterior surfaces 44, 74 of the first arm 30 and the second arm 32, respectively, by the first consumer with, for example, an erasable marker and/or the like. The present invention should not be deemed as limited to the embodiments of a specific method for placing the indicia 104 on the first arm 30 and/or the second arm 32. Moreover, it should be understood that the indicia 104 may be placed on the first arm 30 and the second arm 32 by any method that may be implemented by one having ordinary skill in the art.

The indicia 104 and/or the color of the apparatus 10 may identify the first consumer. For example, the indicia 104 may contain a word, such as, for example, "baseball." Further, the first arm 30 and/or the second arm 32 may be a color, such as, for example, blue. The first consumer may label the beverage container 12 by attaching the apparatus 10 to the beverage container 12. The first consumer may apply force to the first handle 48 and the second handle 78 to separate the bottom edges 42, 72 of the first arm 30 and/or the second arm 32. The first consumer may insert the top end 14 of the beverage container between the bottom edges 42, 72 of the first arm 30 and the second arm 32. The first consumer may stop applying the force to the first handle 48 and/or the second handle 78 and/or may release the handles 48, 78. The top end 14 of the beverage container 12 may be held between the bottom edges 42, 72 of the first arm 30 and the second arm 32, respectively. As a result, the apparatus 10 with the indicia 104 may be attached to and/or may hold the beverage container 12. The indicia 104 and/or the color of the apparatus 10 may indicate to the second consumer that the beverage container 12 does not belong to the second consumer.

The beverage container 12 may be labeled by the apparatus 10 and/or the indicia 104 which may be identifiable with the first consumer. As a result, the beverage container may not be misidentified as and/or mistaken as a beverage container 12 belonging to another consumer. The apparatus 10 may be used to identify beverage containers 12 belonging to any number of consumers. The first consumer may attach the apparatus 10 to the beverage container 12. As a result, the beverage container 12 may be identifiable with the first consumer. Another consumer may not mistakenly drink from the straw 28 of the beverage container 12 because the indicia 104 displayed by and/or the color of the apparatus 10 indicates to the other consumer that the beverage container 12 belongs to another consumer. As a result, the germs and/or the bacteria of the first consumer may be prevented from passing from the first consumer to another consumer via the straw 28 and/or the beverage container 12.

The first consumer may drink the beverage from the beverage container 12 via the straw 28 without obstruction from the first handle 48 and/or the second handle 78. Placing the first handle 48 and the second handle 78 at the first end 14 may allow the straw 28 to be utilized without the first handle 48 and/or the second handle 78 contacting a face, a nose, eyes and/or lips of the first consumer. Further, the length 34 of the first arm 30 and/or the second arm 32 may prevent the first consumer and/or another consumer from swallowing and/or choking on the apparatus 10.

FIG. 4 illustrates a cross-sectional view of an apparatus 200 in an alternate embodiment of the present invention. The apparatus 200 has the first arm 230 and the second arm 232. Further, the first arm 230 and the second arm 232 may have the first handle 48 and the second handle 78, respectively. The first arm 230 may have the first mount 60 and/or the second mount 64. The second arm 232 may have the first mount 90 and/or the second mount 92. The pin 94 may be inserted into the hole 62 of the first mount 60 of the first arm 30. Further, the pin 94 may extend through the first mount 60 into the hole of the first mount 90 of the second arm 32. A flat spring 202 may be located between the first mount 90 and the second mount 92 of the second arm 32. Further, the flat spring 202 may be located between the first arm 30 and the second arm 32. The flat spring 202 may be, for example, U-shaped. The flat spring 202 may have a first end 204 and/or a second end 206. The second end 206 is opposite to the first end 204. The flat spring 202 may have a bend 208 located between the first end 204 and the second end 206 of the flat spring 202. The flat spring 202 may be a flat ribbon or strip made from a material, such as, for example, steel, metal and/or the like.

The pin 94 may pass from the first mount 90 of the second arm 32 through the second mount 92 of the second arm 32 and/or into the hole 65 of the second mount 64 of the first arm 30. As a result, the flat spring 202 may be connected to the first arm 30 and/or the second arm 32. The first end 204 of the flat spring 202 may abut a first lip 210 on the interior surface 54 of the first handle 48. The second end 206 of the flexible strip 202 may abut a second lip 212 on the interior surface 84 of the second handle 78. The first arm 30, the second arm 32, the pin 94 and the flat spring 202 may be, for example, a clip.

The first end 204 of the flat spring 202 may be adjacent to the interior 46 and/or the first lip 210 of the first arm 30. The second end 206 of the flat spring 204 may be adjacent to the interior 76 and/or the second lip 212 of the second arm 32. The first end 204 and/or the second end 206 of the flat spring 202 may extend outward with respect to the top edges 40, 70 of the first arm 30 and the second arm 32, respectively.

The first arm 230, the second arm 232, the first handle 48, the second handle 78, the first lip 210, the second lip 212, the first mounts 60, 90, the second mounts 64, 92, and/or the ribs 58, 88 may be a color, such as, for example, red, blue, green, white, black, purple, orange and/or the like. Further, the first arm 230, the second arm 232, the first handle 48, the second handle 78, the first lip 210, the second lip 212, the first mounts 60, 90, the second mounts 64, 92, and/or the ribs 58, 88 may be a combination of more than one color. The first arm 230 and/or the second arm 232 may be molded by a molding procedure, such as, for example, injection molding, compression molding and/or the like. It should be understood that the first arm 230 and/or the second arm 232 may be any color or colors and/or may be molded by any method that may be implemented by one having ordinary skill in the art.

The first end 204 and/or the second end 206 of the flat spring 202 may exert forces outward with respect to each other. Further, the flat spring 202 may force the first handle 48 of the first arm 30 outward with respect to the second handle 78 of the second arm 32. The bottom edge 42 of the first arm 30 may be pushed inward with respect to the bottom edge 72 of the second arm 32. As a result, the bottom edge 42 of the first arm 30 may abut the bottom edge 72 of the second arm 32. The first end 204 and/or the second end 206 may hold the bottom edge 42 of the first arm 30 against the bottom edge 72 of the second arm 32.

The apparatus 200 may display the indicia 104 which may identify the first consumer. The first arm 30 and/or the second arm 32 of the apparatus 200 may display the indicia 104. The indicia 104 may be attached to an exterior surface 234 of the first arm 230 and/or an exterior surface 236 of the second arm 232.

The apparatus 200 may be attached to the beverage container 12. The top end 14 of the beverage container may be inserted between bottom edges 240, 242 of the first arm 230 and the second arm 232, respectively, of the apparatus 200. The flat spring 202 may be pinch and/or may hold the top end 14 of the beverage container 12 between the bottom edges 240, 242 of the first arm 30 and the second arm 32, respectively. As a result, the apparatus 200 with the indicia 104 may be attached to the beverage container 12.

Figure 6:
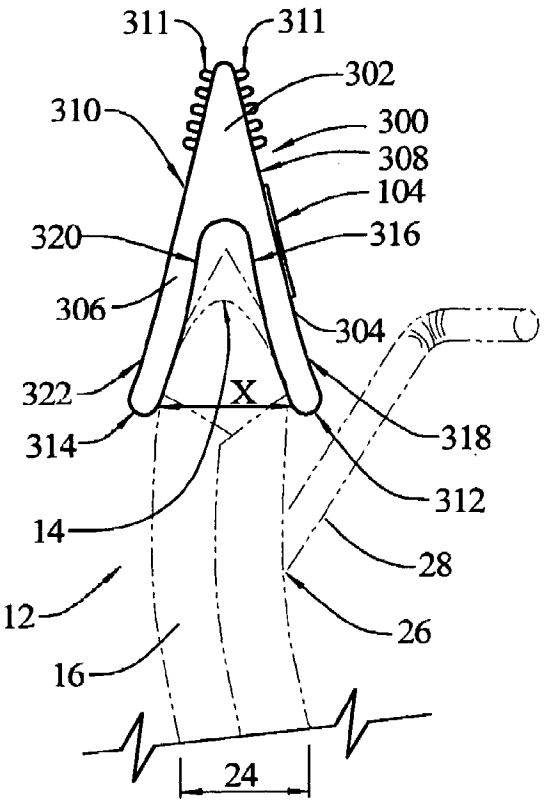
FIG. 6 illustrates a side view of an apparatus and a beverage container in another embodiment of the present invention.
Figure 5:
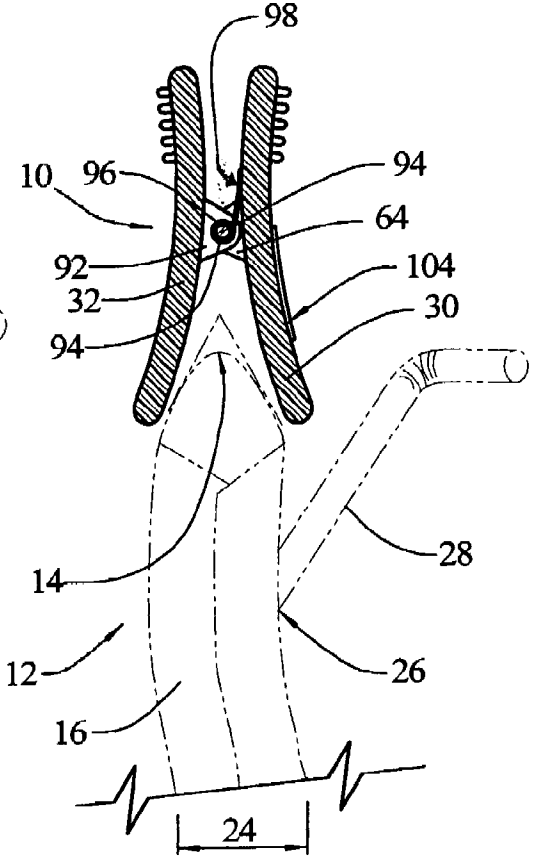
FIG. 5 illustrates a cross-sectional view of the apparatus and the beverage container as taken along line III-III of FIG. 1 in an embodiment of the present invention.

FIG. 6 illustrates a side view of an apparatus 300 in an alternate embodiment of the present invention. The apparatus 300 may have a base 302 which may have a first arm 304 and/or a second arm 306. The base 302 may be integrally formed with the first arm 304 and/or the second arm 306. The base 302 may have a first side 308 and/or a second side 310. The first side 308 of the base 302 may be adjacent to the first arm 304. The second side 310 may be adjacent to the second arm 306. The first side 308 and/or the second side 310 of the base 302 may have ribs 311. The base 302 may be integrally formed with the ribs 311. The ribs 311 may be used to grip and/or to hold the base 300.

The first arm 304 and the second arm 306 may have a first end 312 and a second end 314, respectively. The first arm 304 may have an interior surface 316 and/or an exterior surface 318. The second arm 306 may have an interior surface 320 and/or an exterior surface 322. The first arm 304, the second arm 306, the base 302 and/or the ribs 311 may be a color, such as, for example, red, blue, green, white, black, purple, orange and/or the like. Further, the first arm 304, the second arm 306, the base 302 and/or the ribs 311 may be a combination of more than one color. The base 302 integrally formed with the first arm 304, the second arm 306 and/or the ribs 311 may be molded by a molding procedure, such as, for example, injection molding, compression molding and/or the like. It should be understood that the base 302 may be any color or colors and/or may be molded by any method that may be implemented by one having ordinary skill in the art.

The apparatus 300 may display the indicia 104 which may identify the first consumer. The first arm 304 and/or the second arm 306 of the apparatus 300 may display the indicia 104. The indicia 104 may be attached to the exterior surface 318 of the first arm 304 and/or the exterior surface 322 of the second arm 306.

The apparatus 300 having the indicia 104 may be attached to the beverage container 12. The first end 312 of the first arm 304 may be separated from the second end 314 of the second arm 306 by a distance X. The distance X may be less than the width 24 of the beverage container 12. The top end 14 of the beverage container 12 may be inserted between the first arm 304 and the second arm 306 of the base 302. The top end 14 may be adjacent to the base 302 and/or the interior surfaces 316, 320 of the first arm 304 and the second arm 306, respectively. The top 14 of the beverage container may be pinched between and/or held by the first arm 304 and the second arm 306 of the base 302. As a result, the base 302 having the indicia 104 may be connected and/or attached to the beverage container 12. The beverage container 12 may be labeled by the base 302 and/or the indicia 104.

The apparatus 10 may be attached to the top end 14 of the beverage container 12 to label and/or to identify the beverage container 12. The apparatus 10 may have the indicia 104 which may identify that the beverage container belongs to the first consumer. The apparatus 10 and/or the indicia 104 may indicate to another consumer that the beverage container 12 belongs to the first consumer. The other consumer may refrain from drinking from the beverage container 12. As a result, the other consumer may prevent the contraction of the germs and/or the bacteria from the first consumer via the straw 28. Moreover, the beverage container may not mistakenly be discarded because the owner of the beverage container 12 is identifiable via the apparatus 10 and/or the indicia 104.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus comprising:

a first arm having a length defined between a first end and a second end wherein the second end is opposite to the first end and further wherein the first arm has a height defined between a top edge and a bottom edge wherein the bottom edge is opposite to the top edge wherein the height of the first arm is uniform along the length of the first arm;

a first handle integrally formed with the first arm wherein the first handle has a length defined between a first end and a second end wherein the second end is opposite to the first end wherein the first handle has a height defined between a top edge and a bottom edge wherein the bottom edge is opposite to the top edge wherein the height of the first arm is greater than the height of the first handle wherein the first handle extends outward with respect to the top edge of the first arm and further wherein the first handle is adjacent to the first end of the first arm;

a second arm having a length defined between a first end and a second end wherein the second end is opposite to the first end wherein the second arm has a height defined between a top edge and a bottom edge wherein the bottom edge is opposite to the top edge and further wherein the bottom edge of the second arm is adjacent to the bottom edge of the first arm wherein the first arm extends in cross-section from the bottom edge of the first arm parabolically toward the bottom edge of the second arm to a point located between the bottom edge of the first arm and the top edge of the first arm and further wherein the first arm extends in cross-section parabolically away from the bottom edge of the second arm from the point to the top edge of the first arm wherein the second arm is connected to the first arm; and a second handle integrally formed with the second arm wherein the second handle has a length defined between a first end and a second end wherein the second end is opposite to the first end wherein the second handle has a height defined between a top edge and a bottom edge wherein the bottom edge is opposite to the top edge wherein the second handle extends outward with respect to the top edge of the second arm and further wherein the second handle is adjacent to the first end of the second arm.

2. The apparatus of claim 1 further comprising:

a pin attaching the second arm to the first arm.

3. The apparatus of claim 1 further comprising:

a spring between the first arm and the second arm.

4. The apparatus of claim 1 wherein the height of the second arm is greater than the height of the second handle.

5. The apparatus of claim 1 further comprising:

an indicator on the first arm wherein the indicator is a first color wherein the first arm is a second color.

6. The apparatus of claim 1 further comprising:

a plurality of ribs on the first handle wherein each of the plurality of ribs has a length defined between a first end and a second end wherein the second end is opposite to the first end wherein each of the plurality ribs has a height defined between a top edge and a bottom edge wherein the bottom edge is opposite to the top edge wherein the length of each of the plurality of ribs is greater than the height of each of the plurality of ribs wherein each of the plurality of ribs extends outward with respect to the first handle.

7. The apparatus of claim 1 further comprising:

an indicator on the first arm wherein the indicator is indicia.

8. A system for identifying a container from a plurality of containers, the system comprising:

a first arm having a length defined between a first end and a second end wherein the second end is opposite to the first end and further wherein the first arm has a height defined between a top edge and a bottom edge wherein the bottom edge is opposite to the top edge wherein the height of the first arm is uniform from the first end to the second end;

a second arm having a length defined between a first end and a second end wherein the second end is opposite to the first end and further wherein the second arm has a height defined between a top edge and a bottom edge wherein the bottom edge is opposite to the top edge and further wherein the bottom edge of the first arm is adjacent to the bottom edge of the second arm;

an attaching means positioned between the first arm and the second arm wherein the attaching means is secured to the first arm between the bottom edge of the first arm and the top edge of the first arm wherein a height of the first arm between the bottom edge of the first arm and the attaching means is greater than a height of the first arm between the attaching means and the top edge of the first arm wherein the first arm extends in cross-section from the bottom edge of the first arm parabolically toward the bottom edge of the second arm to a point located between the bottom edge of the first arm and the attaching means and further wherein the first arm extends in cross-section parabolically away from the bottom edge of the second arm from the point to the attaching means wherein the attaching means moves the bottom edge of the first arm outward with respect to the bottom edge of the second arm and further wherein the attaching means moves the first end of the first arm toward the first end of the second arm wherein the first arm moves independently with respect to the second arm; and indicia on the first arm wherein the indicia has a perimeter wherein the perimeter of the indicia is located between the first end of the first arm and the second end of the first arm and further wherein the perimeter off the indicia is located between the top edge of the first arm and the bottom edge of the first arm.

9. The system of claim 8 wherein the attaching means is a spring.

10. The system of claim 8 further comprising:

a pin attaching the first arm to the second arm.

11. The system of claim 8 further comprising:

a handle connected to the attaching means.

12. The system of claim 8 wherein the first arm is a first color wherein the indicia is a second color.

* * * * *